US006058773A

United States Patent [19]

Zimmerman et al.

[11] Patent Number: 6,058,773

[45] Date of Patent: May 9, 2000

[54] APPARATUS AND METHOD FOR SAMPLING FORMATION FLUIDS ABOVE THE BUBBLE POINT IN A LOW PERMEABILITY, HIGH PRESSURE FORMATION

[75] Inventors: Robert P. Zimmerman, Friendswood; Edward Harrigan, Richmond, both of Tex.

[73] Assignee: Schlumberger Technology Corporation, Houston, Tex.

[21] Appl. No.: 09/079,594

[22] Filed: May 15, 1998

Related U.S. Application Data

[60] Provisional application No. 60/046,771, May 16, 1997.

[51] Int. Cl.[7] ..... E21B 49/00

[52] U.S. Cl. ..... 73/152.24

[58] Field of Search ..... 73/152.23–152.26, 73/864.34, 864.35, 864.62, 864.63; 166/264

[56] References Cited

U.S. PATENT DOCUMENTS

| | | | |
|---|---|---|---|
| 3,859,850 | 1/1975 | Whitten et al. | 73/152.24 |
| 4,513,612 | 4/1985 | Shalek | 73/152.24 |
| 4,843,878 | 7/1989 | Purfurst et al. | 73/152.24 |
| 4,878,538 | 11/1989 | Christensen . | |
| 4,936,139 | 6/1990 | Zimmerman et al. . | |
| 5,269,180 | 12/1993 | Dave et al. | 73/152.06 |
| 5,622,223 | 4/1997 | Vasquez | 166/264 |

*Primary Examiner*—Robert Raevis
*Attorney, Agent, or Firm*—John J. Ryberg; Brigitte L. Jeffery; Steven L. Christian

[57] ABSTRACT

A flow-control apparatus enables the taking of representative formation samples at sampling rates less than 10 cc/sec in typical high pressure wells, e.g., to 20,000 psi. Throttle valves are used to control pressure drawdown in the flowline and to continue that pressure control until captured in a sample chamber. Very low flow rates at high pressures are made possible by using a motor-driven, variable orifice, needle valve (throttle valve) and a downhole feedback loop on the piston position. The flow control device uses metered fluid, which is internally contained oil, which overcomes the difficulty of trying to meter "dirty" (particle laden) well fluids or dual phase gas-liquid fluids. A single probe module (or a dual packer) is coupled with a multi-sample module and the flow control module. This combination can then be used to draw a sample from the formation at a very low flowrate and, hence, a very low pressure differential which keeps the sample pressure above the bubble point (or dew point). In a gas well with condensates or volatile oil, this procedure is extremely important since the sample will contain a realistic fraction of the liquids in the well. If the flowline pressure is dropped below the dew point, the gas expands and fills the sample chamber, leaving the liquids behind and an unrepresentative sample is obtained. The present invention provides the unique ability to obtain a quality sample from low permeability, high pressure formations.

16 Claims, 9 Drawing Sheets

APPARATUS AND METHOD FOR SAMPLING FORMATION FLUIDS ABOVE THE BUBBLE POINT IN A LOW PERMEABILITY, HIGH PRESSURE FORMATION

This application claims the benefit of Provisional Application Ser. No. 60/046,771 filed May 16, 1997.

BACKGROUND OF THE INVENTION

1. Field of the Invention

The invention is directed to methods and apparatus for recovering representative connate samples taken from low permeability, high pressure formations.

2. Description of the Prior Art

A goal of earth formation testing is to obtain representative samples of fluids extracted from the formation. In order to control the pressure drop from the formation pressure to the sample chamber, previous techniques for extracting a fluid sample include the use of passive, fixed chokes to meter water exiting from the back side of a piston while the sample is received on the top. Assignee's Modular Dynamics Formation Tester, also known as the MDT, a mark of Schlumberger, uses throttle valves at the sample chamber inlet to control pressure drawdown in the flowline. However, the MDT does not control the pressure once the fluid passes the throttle valve. The sample chamber with the throttle valve is also used as the water receiver for multi-sample bottles to control the flow rate; however, this combination is unable to achieve sufficiently low flowrates to prevent flow line pressure from dropping below the bubble point.

Reservoir engineers use wireline formation testers to obtain pressure profiles, formation fluid samples and permeability indicators—information that is crucial during exploration and development of oil and gas fields. Wireline formation testers have been used to collect formation fluid samples. The instant invention improves the quality of samples by using techniques and apparatus for downhole fluid analysis which include: a system for discarding contaminated fluids before taking samples, identifying the fluid flowing from the formation and limiting the drawdown pressure by using precision flow control methods, i.e., very low flow rates (e.g., 1 cc/sec) at very high pressures (up to 20,000 psi).

Proper reservoir management requires formation pressure measurements in a wide range of conditions. Formation pressure measurements taken within a well can be plotted versus true vertical depth to produce a pressure profile. Formation pressure is obtained by withdrawing a small amount of fluid from the formation to generate a short transient test. The pressure response is then recorded during shut-in until it stabilizes.

A major problem which occurs in low-permeability reservoirs is the relatively high drawdown that occurs during sampling. In some cases, this drawdown lowers the flowing pressure below the bubblepoint pressure at which gas is liberated from the solution, thereby producing an unrepresentative sample. In gas condensate reservoirs, the sampling pressure may be lower than the dew point pressure and liquid may remain in the formation while the gas escapes, again providing a nonrepresentative sample. The instant invention offers surface control of drawdown pressure, a feature that allows pretests and sampling in tight reservoirs and avoids large drawdowns.

A major difficulty that commonly occurs when sampling with wireline testers is contamination by deep filtrate invasion during drilling. In the instant invention, properties of the fluid entering the flowline are constantly monitored from the surface using resistivity or temperature and/or optical properties measurements. The formation fluid that enters the tools is returned to the wellbore until a sample is judged to be representative of the formation. This desired fluid sample is then diverted into the sample chambers, allowing the collection of high-quality samples. Furthermore, several samples can be taken during a single run into the hole, thus, several zones can be sampled in a single trip, resulting in rig-time savings.

For the foregoing reasons, there is a need for an apparatus and method which provides a high quality, representative formation sample at a low sample rate in a high pressure, low permeability well.

SUMMARY OF THE INVENTION

A flow-control apparatus enables the taking of representative formation samples at sampling rates less than 10 cc/sec in typical high pressure wells, e.g., to 20,000 psi. Throttle valves are used to control pressure drawdown in the flowline and to continue that pressure control until captured in a sample chamber. Very low flow rates at high pressures are made possible by using a motor-driven, variable orifice, needle valve (throttle valve) and a downhole feedback loop on the piston position. The flow control device uses metered fluid, which is internally contained oil, which overcomes the difficulty of trying to meter "dirty" (particle laden) well fluids or dual phase gas-liquid fluids. A single probe module (or a dual packer) is coupled with a multi-sample module and the flow control module. This combination can then be used to draw a sample from the formation at a very low flowrate and, hence, a very low pressure differential which keeps the sample pressure above the bubble point (or dew point). In a gas well with condensates or volatile oil, this procedure is extremely important since the sample will contain a realistic fraction of the liquids in the well. If the flowline pressure is dropped below the dew point, the gas expands and fills the sample chamber, leaving the liquids behind and an unrepresentative sample is obtained. The present invention provides the unique ability to obtain a quality sample from low permeability, high pressure formations.

DETAILED DESCRIPTION OF THE INVENTION

Figure 1:
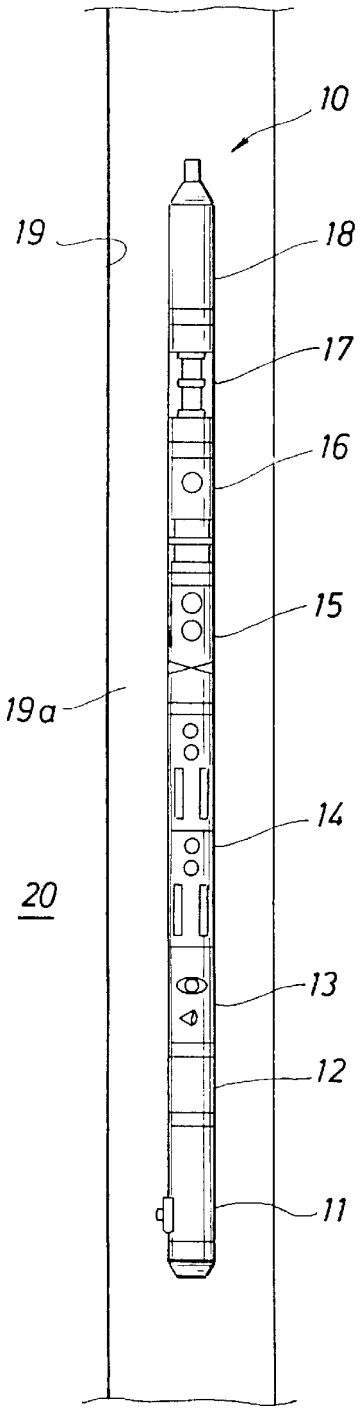
FIG. 1 is a drawing of a typical tool string which incorporates the invention.

FIG. 1 is a schematic illustration of a typical tool string 10 which incorporates the invention for sampling a low permeability formation. The tool string 10 may incorporate (for example) a Single Probe 11, a Hydraulic Unit 12, an Optical Fluid Analyzer 13, a Multi-Sample Module 14, a Flow Control Module 15, a single Sample Chamber 16, a Pumpout/Pumpin Module 17 and a Power Cartridge 18. The tool string 10 is placed in a borehole 19 in order to sample fluids from an earth formation 20. The tool 10 is positioned such that the probe 11 is adjacent to a portion of the formation 20 from which samples are desired. This is done in a manner well known to those skilled in the art.

Figure 4:
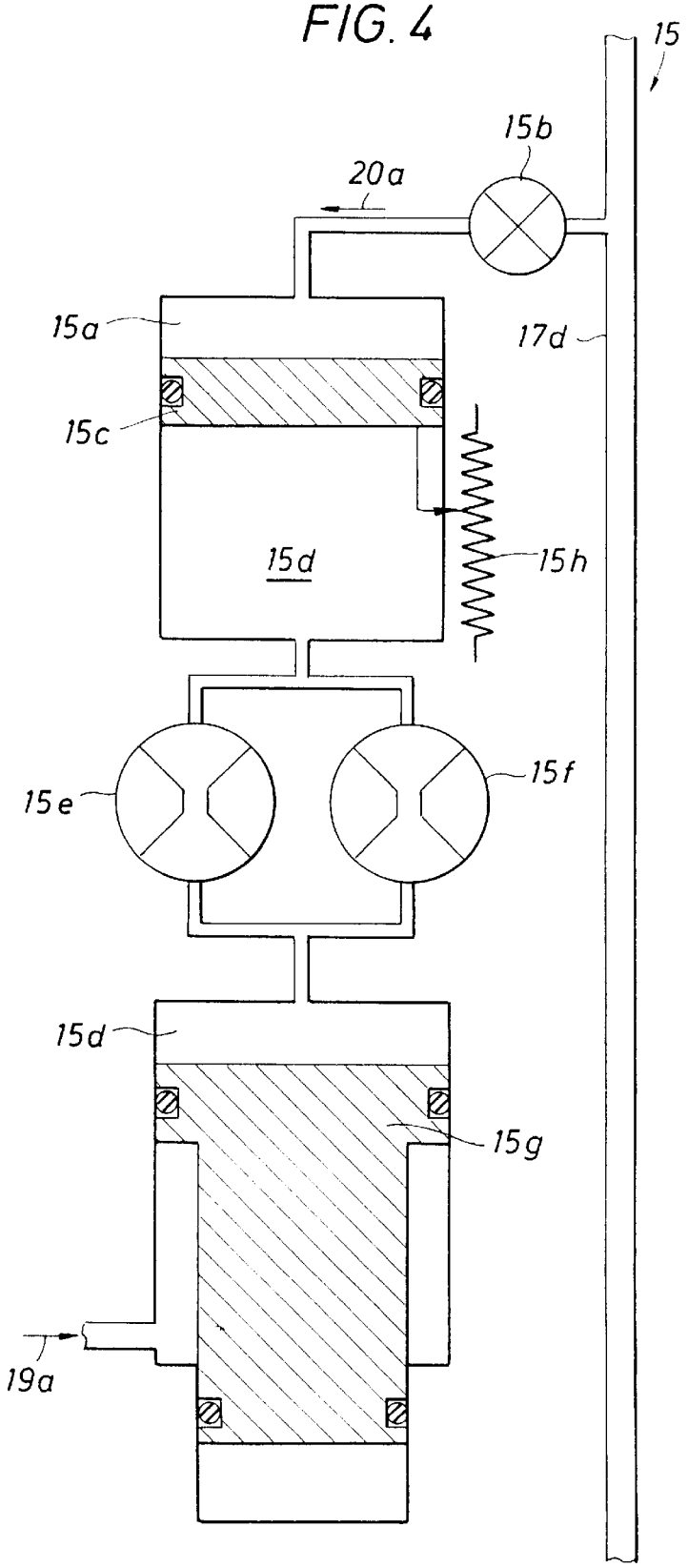
FIG. 4 is a schematic representation of a Flow Control Module incorporating the instant invention.

The tool 10 is designed to control drawdown in order to maintain single phase fluid or to withdraw liquid in near critical reservoirs. The tool has a bussed flowline 17*d* (see FIGS. 2 and 4), which means that the flowline 17*d* passes through each module except the electric power cartridge 18. The main hydraulic communication takes place along a hydraulic bus (not shown) that runs through the hydraulic power module 12 and the single-probe module 11. Any other module needing this hydraulic power must be connected immediately next to the hydraulic power module 12. The electric power module 18 converts AC power from the surface to provide tool electrical DC power along a common electrical bus (not shown) running through all modules. The hydraulic power module 12 contains an electric motor and a hydraulic pump and is the basic hydraulic power source, delivering power by way of the hydraulic bus. Its 50-V DC electric motor drives a fixed-displacement hydraulic pump (i.e., constant volume per revolution) which allows the estimation of the volume of oil pumped by counting the motor revolutions, thus allowing the determination of pretest volume in the probe 11.

Recovering PVT quality samples from an earth formation has three requirements:

1. A system to purge unwanted fluid from the fluid sample,
2. A detection system to indicate fluid type, and
3. An appropriate sample receiver with precise pressure control for filling it.

Figure 2:
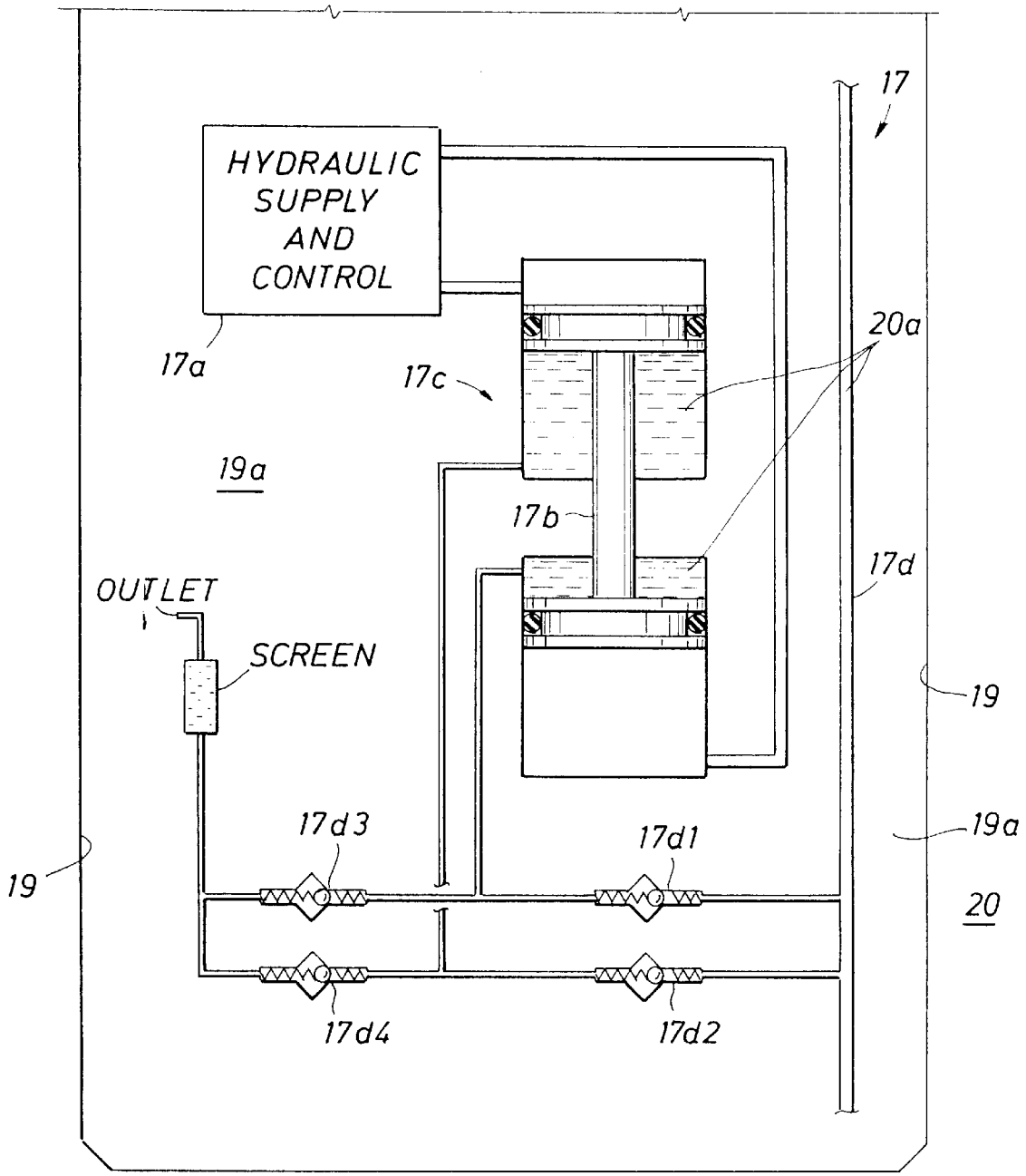
FIG. 2 is a schematic representation of the Pump-Out Module of the instant invention.

The first requirement, a system to purge unwanted fluid from the fluid sample, is met by the expulsion of unwanted fluids into the wellbore, before sampling is performed, by the use of a pump-out module 17. The pump-out module 17, schematically illustrated and further described with relation to FIG. 2, pumps fluid 20*a* directly from the formation 20 into the mud column 19*a* via the flowline 17*d*, thus eliminating any volume limitation on the amount of fluid dumped due to length of the tool 10. This module 17 has the capability to pump any fluid in the flowline 17*d* to the borehole 19 (in pump-out mode) or to pump borehole fluid 19*a* into the flowline 17*d* (pump-in mode). FIG. 2 is shown in the pump-out mode.

Hydraulic communication and a proper seal are first established by conducting conventional pretests at the probe 11. Then, fluid 20*a* is sampled from the formation 20 through the probe 11, and the pressure response is observed during the drawdown and buildup periods at the probe 11.

The pump-out module 17 can operate in one of three modes. In pump-out mode, as shown in FIG. 2, it can pump contaminated fluid 20*a* from the formation 20 into the flow line 17*d* and back out to the borehole 19. In pump-in mode (not shown), the module 17 will pump wellbore fluid 19*a* into the flowline 17*d* for distribution to other modules as needed. The third mode is the internal mode, in which the module 17 can pump from one point in the flowline to any other point in it. For example, clean fluid can be pumped from a sample chamber 14, 16 (FIG. 1) into inflatable packers (not shown). An additional advantage of the pump-out device 17 is the ability to limit the drawdown pressure applied to the formation 20, which greatly reduces seal failures.

The change from pump-out to pump-in mode and vice versa can be made in real time with commands from wellsite surface instrumentation as subsequently described in relation to FIG. 6 and which is well known to those skilled in the art. But the internal mode must be physically set up with a valve on the tool 10 before going into the hole 19. When internal mode is selected, the other two/modes of operation are disallowed. The module 17 has its own DC motor and hydraulic pump 17*a* and does not rely on the hydraulic power module 12. Hydraulic power from pump 17*a* is used to drive a shuttle piston 17*b* in the displacement unit 17*c* where the borehole fluid 19*a* or formation fluid 20*a* is actually pumped. Formation fluid 20*a* is pumped through check valves 17*d*1 or 17*d*2 into the displacement unit 17*c*. The fluid 20*a* is then pumped through check valve 17*d*3 or 17*d*4 into the wellbore 19*a*. Wellbore 19*a* pressure prevents fluid from check valves 17*d*1 and 17*d*2 going directly into the wellbore 19*a*. The cumulative volume is measured by counting the number of shuttle piston 17*b* strokes and is displayed on the log described with relation to FIG. 9.

The second requirement for the recovery of PVT quality fluid samples is a detection system to indicate fluid type. A flowline resistivity sensor helps to discriminate mud filtrate and formation fluids and, in the instant invention, the resistivity sensor 11*b* in the probe module 11 (see FIG. 7) provides a resistivity measurement over a wide range as is well known to those skilled in the art. Under certain conditions, particularly in wells drilled with oil-base mud, the resistivity measurement cannot discriminate between formation fluids 20*a* and mud filtrate in the borehole fluid 19*a*. In these cases, optical analysis can identify the flowline fluids 20*a* by using optical absorption spectrometry in the near-infrared range to differentiate between oil and water, while gas is detected by measurements of different reflection angles. An optical fluid analyzer (OFA) module 13, run immediately above the probe module 11 as shown in FIG. 1, uses optical analysis techniques well known to those skilled in the art to identify the fluid in the flowline 17*d*. During the test, the engineer monitors the resistivity and/or optical properties of the flowline fluid 20*a* while pumping. When the fluid quality is representative of the reservoir 20 fluid, the pump 17 is stopped and pure formation fluid 20*a* is diverted to a sample chamber 14, 16 (see FIG. 7).

Figure 7:
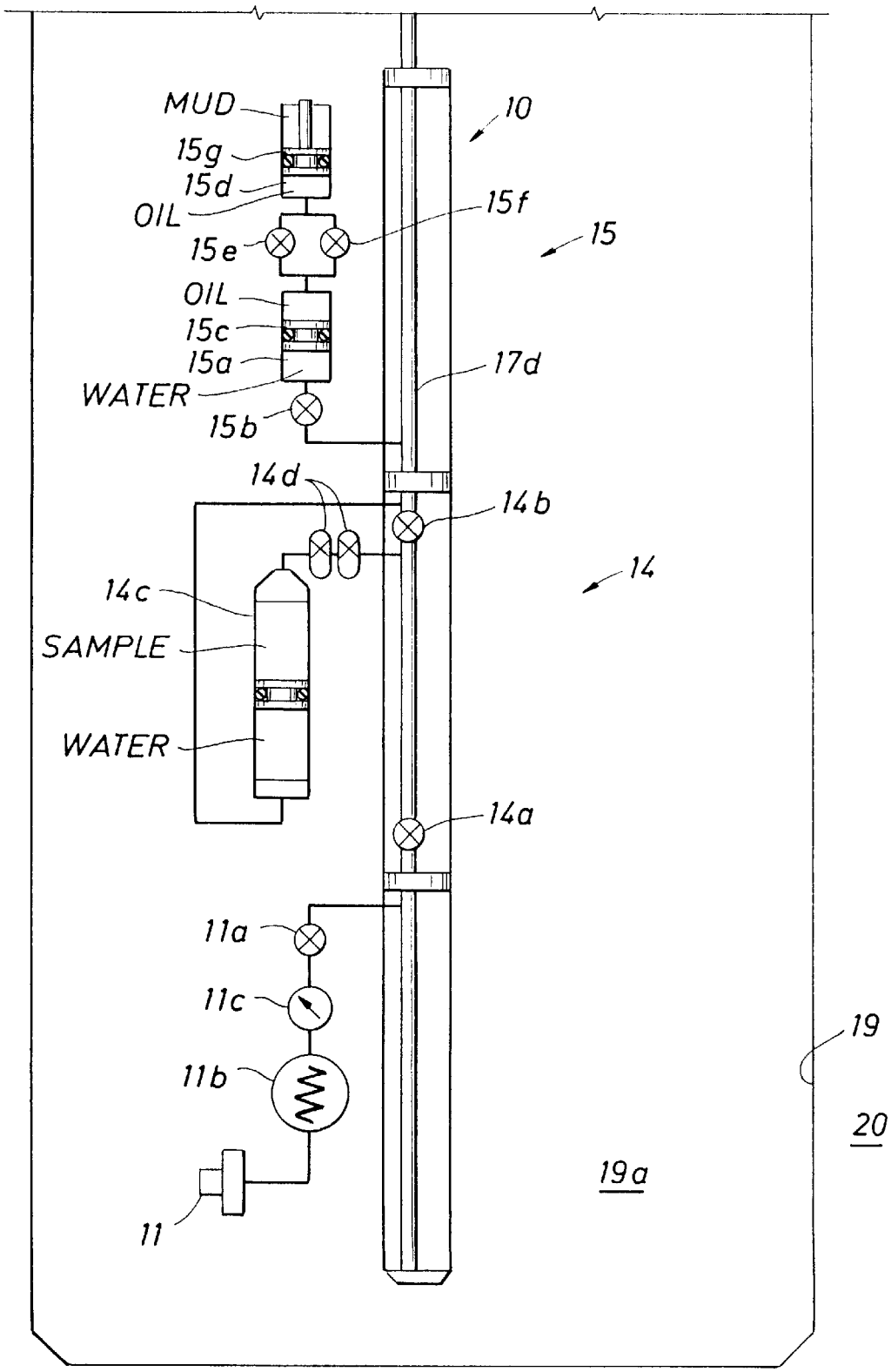
FIG. 7 is a schematic representation of the invention as used in a typical application.

The third requirement for PVT quality samples is an appropriate sample receiver. The multisample module 14 of the instant invention contains six sample chambers mounted in a single carrier for providing this capability. Each sample cylinder 14*c* collects a sample suitable for PVT analysis. Surface-controlled valves 14*d* open and close specific sample bottles as required. Only one sample bottle 14*c* is shown in FIG. 7 for ease of illustration. In the instant invention, a throttling valve 15*e* or 15*f* (discussed with relation to FIG. 5 below) acting as an outlet choke, provides precise pressure control while collecting the sample.

Figure 3:
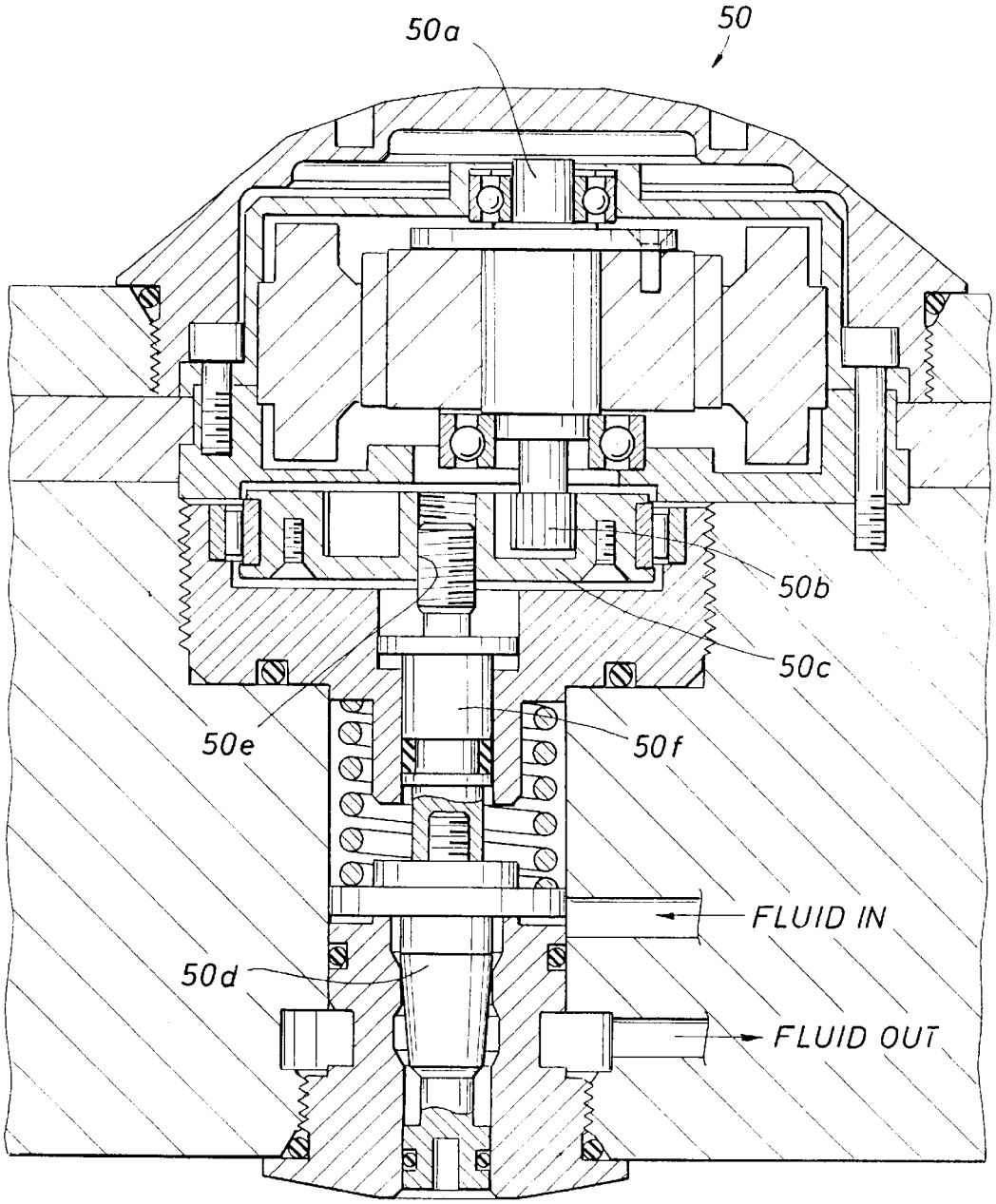
FIG. 3 (PRIOR ART)
FIG. 3 is a drawing of Assignee's Prior Art throttling valve.

FIG. 3 illustrates Assignee's prior art metering valve 50 used in flow control module 15 previously identified as the MDT. The motor 50*a* is connected to a pinion gear 50*b* which drives a ring gear 50*c* having a four-to-one mechanical advantage to amplify the torque. The metering piston 50*d* has a 2° or 5° taper ground on a 0.375-inch diameter to vary the flow. The piston 50*d* is connected to the drive train by a threaded connection 50*e* to the ring gear 50*c*. As the seal valve 50*d* actuator 50*f* approaches the closed position, the high differential pressure across the 0.375-inch diameter valve stem deflects the drive train and the valve 50*d* closes. Below a flow rate of approximately 25 cc/sec, the valve 50*d* repeatedly opens and closes. The resulting oscillating flow does not allow control at the desired rates, i.e., less that 10 cc/sec. The present invention overcomes this problem.

Figure 5:
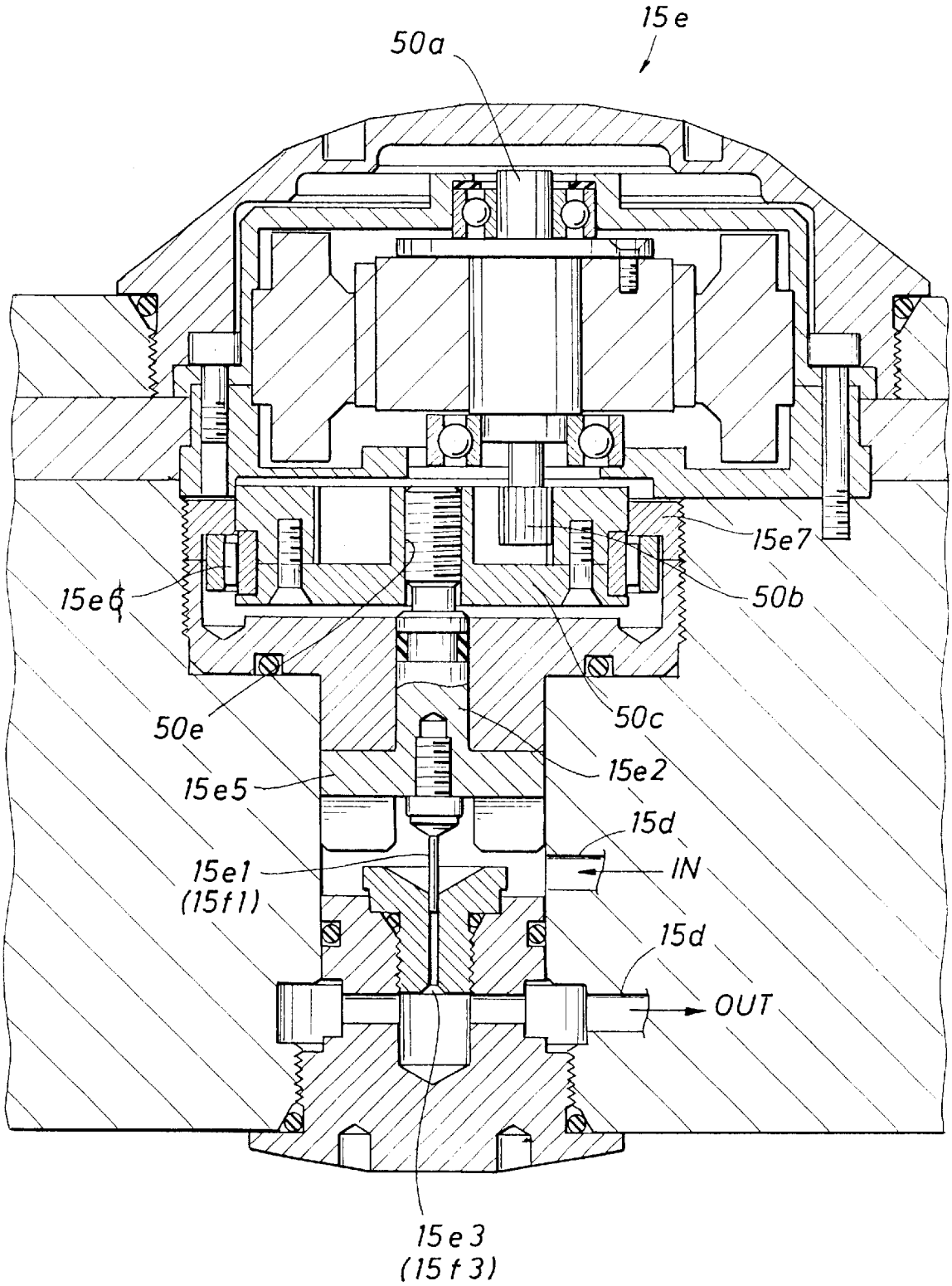
FIG. 5 is a drawing of an improved valve according to the invention.

FIG. 5 illustrates the coarse metering valve 15*e* used in flow control module 15 of the subject invention which uses the same motor 50*a* and ring gear 50*c* combination of the prior art system of FIG. 3. As in FIG. 3, the motor 50*a* drives a ring gear 50*c,* via a pinion gear 50*b*. The hub of the ring gear has a screw thread 50*e* as in FIG. 3. So, by turning the ring gear 50*c,* the valve stem moves the needle 15*e*1 up or down. The actuator 15*e*2 and the valve stem are screwed together so they operate as one, but they are driven by the screw thread 50*e* in the hub of the ring gear 50*c*. A needle 15*e*1 is connected to the metering valve actuator 15*e*2 and the needle 15*e*1 engages orifice 15*e*3. The throttle/seal valve orifice 15*e*3 has an approximate 0.048-inch diameter for a coarse needle 15*e*1. Other size needles may be used and an orifice 15*f*3 has an approximate 0.032-inch diameter for a fine needle 15*f*1. The needles 15*e*1, 15*f*1 and their mating orifices 15*e*3, 15*f*3 are the only differences in the metering valves 15*e* and 15*f*. An actuator linear stop and anti-rotation device 15*e*5 is located at the bottom of the actuator 15*e*2. The ears of the actuator 15*e*2 move within a slot machined into the lower portion of the valve base retainer. The ring gear 50*c* and actuator assembly is fixedly mounted into the base retainer by bearings 15*e*6 and is locked down to the motor 50*a* assembly by locking ring 15*e*7 which provides the needle 15*e*1, 15*f*1 with a fixed frame of reference. This results in a more rigid drive train that is unaffected by the differential pressure across the needle 15*e*1. Instead of the 0.375-inch bore as in the prior art system of FIG. 3, a bore of about 0.032-inch is used along with a fine needle 15*f*1. The coarse needle 15*e*1 is about 0.048-inch in diameter. Both needles 15*e*1, 15*f*1 are tapered about 1 degree. An additional, extra fine needle, is the same size as fine needle 15*f*1 has no taper at all and is used in even higher pressures to obtain lower flow rates. In the latter instance, flow is determined by how much of the straight shank needle is engaged in the orifice 15*f*3.

Figure 6:
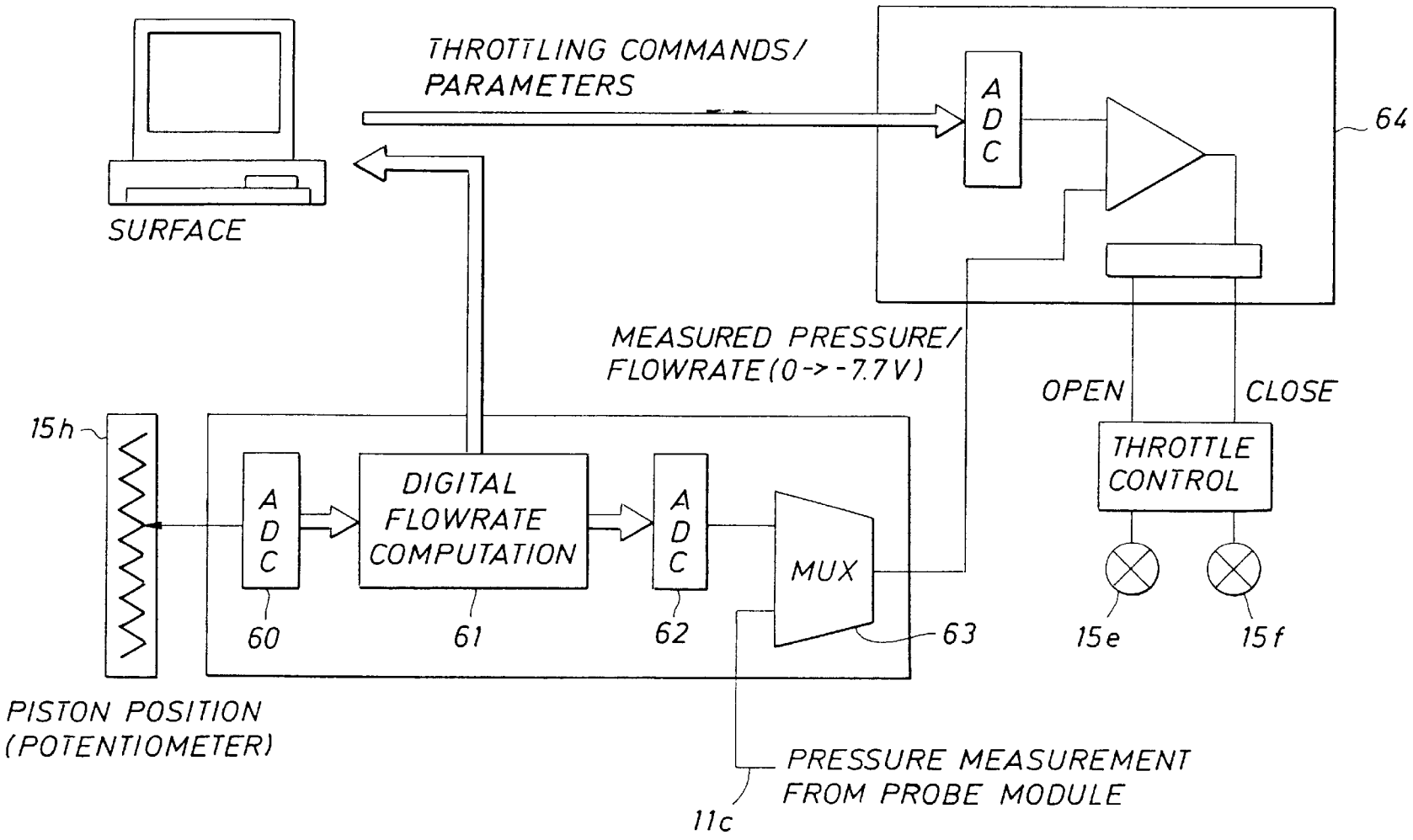
FIG. 6 is a schematic block diagram of the overall system incorporating the instant invention.

Referring now to FIG. 6, the flow control module 15 includes an electronics assembly which computes a flowrate measurement downhole. An analog piston 15*c* position measurement from potentiometer 15*h* (FIG. 4) is converted to a digital measurement by A-D converter 60, stored in a memory and computation device 61 and transmitted uphole to the surface instrumentation. Consecutive piston 15*c* position measurements are subtracted to compute a real time estimate of flowrate. The computed flowrate is transmitted uphole and is also converted from a digital signal to an analog voltage in D-A converter 62, which varies between 0V and −7.7V, where 0V represents a flowrate of 304 cc/sec and −7.7V represents a flowrate of 0 cc/sec. The electronic controller has a resolution of ¼ cc/sec, i.e., set points can be chosen in ¼ cc/sec increments from zero to 304 cc/sec.

An analog pressure measurement is also provided by pressure transducer 11*c* in the sampling probe 11. A multiplexer 63 is used to select either the flowrate measurement from computation circuit 61 or the analog pressure measurement from probe 11 as a control parameter. The selected measurement is then sent to the throttling circuitry 64. The throttling circuitry 64 maintains a constant pressure or flowrate (as selected by multiplexer 63) by varying the position of one of the motor-driven metering valves 15*e,* 15*f*. By opening one of the valves 15*e,* 15*f,* the pressure drawdown and flowrate can be increased. By closing the valve 15*e,* 15*f,* the pressure drawdown and flowrate can be reduced. The user selects either a desired pressure or flowrate set point from the surface. An error band is also chosen at the surface which specifies a region around the set point for which the valve 15*e,* 15*f* is inactive. Valve 15*e,* 15*f* motor speed is also controlled from the surface to increase or reduce response speed of the system to dynamics in the flow path. The user can, from the surface, select which metering valve 15*e,* 15*f* is used.

Referring now to FIG. 7, during operation to identify formation fluids 20*a,* the tool 10 probe 11 is set against the formation 20 and a pretest is performed to verify seal integrity. Then, the engineer starts the pump-out module 17 to draw fluids 20*a* from the formation 20 into the tool string's flowline 17*d*. As the formation fluids 20*a* pass through the OFA module 13, the engineer, guided by the real-time interpretation of the measurements, can estimate the proportions of oil and water and get a clear indication of free gas. The pump-out module 17 draws fluid 20*a* from the formation 20 until a sufficiently high percentage of contaminants are removed. With probe isolation valve 11*a* open and valves 14*a* and 14*b* open, fluid will flow through the probe 11 and into the flowline 17*d*. The sample chamber section 15*a* of the flow control module 15 (shown in more detail in FIG. 4) has an electromechanically-actuated seal valve 15*b,* which is controlled from the surface and directs fluid 20*a* in flowline 17*d* to the chamber 15*a*. Fluid 20*a* enters through the seal valve 15*b* and displaces the sample piston 15*c*. The hydraulic oil 15*d* is displaced through coarse 15*e* or fine 15*f* metering valves (see FIG. 5). The selected metering valve operates as a variable orifice that automatically opens and closes to maintain the flowing pressure constant. The throttle valve 15*e* or 15*f* is a dynamic valve, constantly adjusted to maintain a specified flowline sampling pressure within an error band. The engineer specifies the operating parameters of this valve. Flow rate into the tool is regulated by metering a clean fluid (hydraulic oil) 15*d* through the motor-driven metering valves 15*e* or 15*f*. The metered fluid moves a stepped-down piston 15*g* having a 3.5:1 surface area ratio. On one side of the piston is wellbore fluid 19*a* at hydrostatic pressure. On the opposite side is hydraulic oil 15*d* at a pressure equal to a fraction of the hydrostatic pressure (i.e., 1/3.5). Thus the step piston 15*g* will move only if the formation flowing pressure is greater than 29% of the hydrostatic pressure. A linear potentiometer 15*h* measures the sample piston 15*c* position so that the volume, and hence flow rate, can be measured. The fine metering valve 15*f* gives better control over the lower flow rates, whereas the coarse control 15*e* allows for higher flow rates. These valves can be set in fixed position or throttled to regulate either pressure or flow rate. Only one valve is used at a time. In the illustration described, the probe 11 extends against the borehole 19 wall to provide a sealed fluid path from the reservoir 20 to the flowline 17*d*. It will be appreciated by those skilled in the art that a sealed fluid path may be obtained by means other than a probe actually pressing against the borehole wall. For example, a fluid path may be obtained by dual packers which seal off a section of formation to be tested. Fluid 20*a* from the formation 20 may then flow into a passage drilled into the tool between the dual packers. The pretest is used to ensure a good hydraulic seal, obtain accurate formation pressure recordings and determine permeability.

This apparatus can also be used to perform controlled drawdown pretests. To conduct a pretest, conventional tools expand the flowline using a fixed fluid volume. However, in low-permeability formations, the time needed to replace this volume can be prohibitively long. Therefore it is desirable to minimize stabilization time by controlling the pretest volume and limiting the pressure drawdown. This is done in conventional tools by controlling the pump rate and volume acting on the pretest piston or by reducing the capacity of the pretest chamber at the surface before running in the well. The instant invention improves on this approach since both the pretest volume and flow rate (and, thus, drawdown pressure) can be accurately controlled from the surface, allowing the testing of tight formations. The high resolution piston position measurement from the potentiometer 15*h* makes possible an accurate flowrate measurement which is essential for permeability determination. Additionally, the ability to take a pretest at a controlled constant flowrate allows for a more accurate permeability determination. The 1000 cc chamber 15*a* in the Flow Control Module 15 allows larger pretests to be taken than in conventional probe pretests, which are typically 20 cc or less.

Figure 8A:
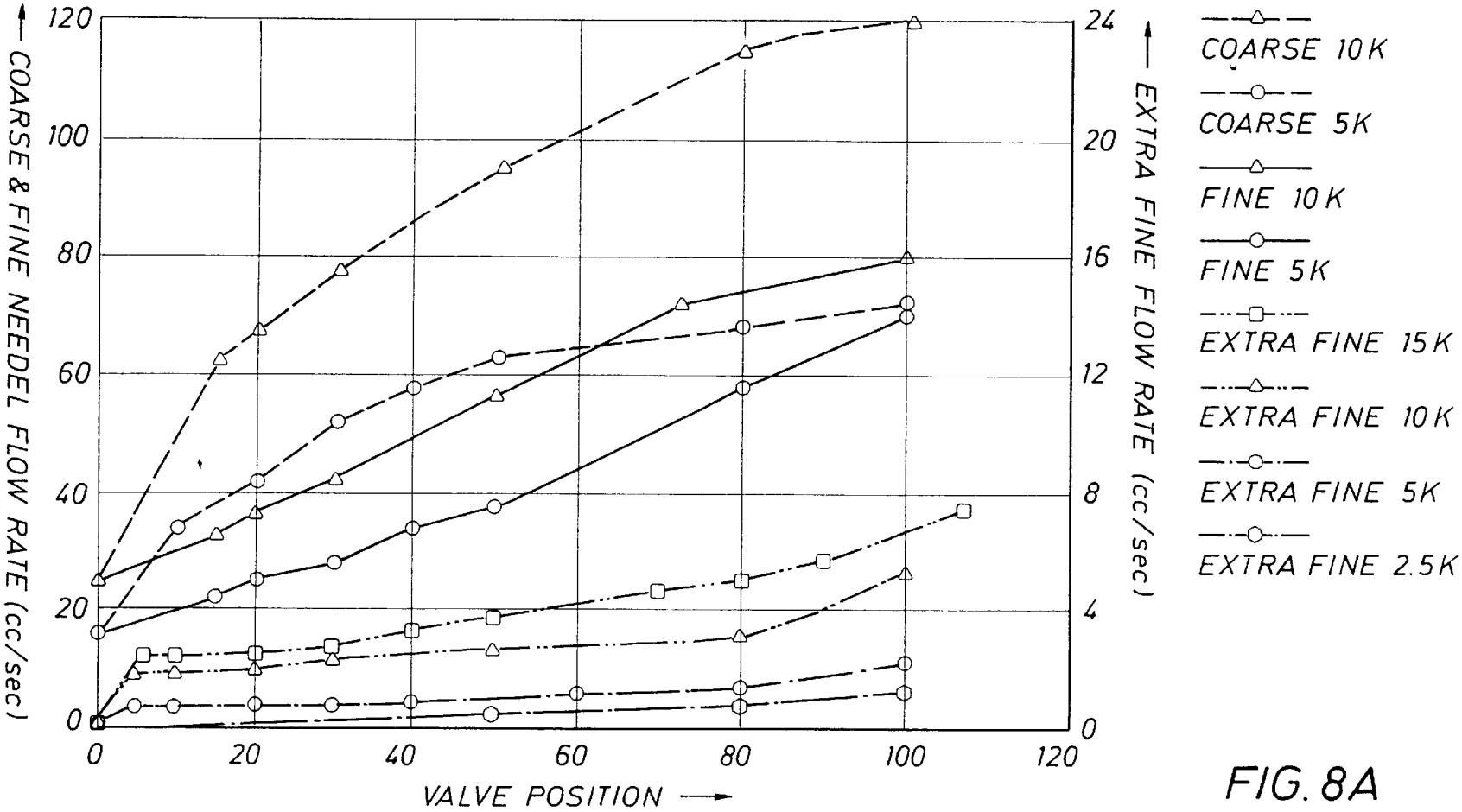
FIG. 8A is a graph showing the comparative performance of the valve according to the embodiments of FIG. 5 with pressures as low as 2,500 psi.

FIG. 8A illustrates flow rates for coarse, fine, and extra fine needles at predetermined pressures of 2,500, 5,000, 10,000 and 15,000 psi. It will be noted that flow rates from as low as zero to 4 cc/sec are obtainable. With the flow control module 15 of the subject invention, a formation sample is obtained at a slow flow rate to reduce the chance of gas-liquid separation or to prevent formation collapse in the case of highly unconsolidated sand formations. After setting the probe 11 and performing the pre-test, the formation 20 may be cleaned by running the pump-out 17 at a low power duty cycle to limit the pressure drawdown. The sample may then be taken by using the flow control module 15 as the water receiver for the multi-sample (see FIG. 7). Both metering valves 15*e,* 15*f* are closed before starting to sample. The choice is to control flow as a function of either flowline pressure or flow rate. Throttling pressure is set just below formation 20 pressure. Alternatively, the flowrate is specified as a low number, e.g., less than 10 cc/sec. After the sample bottle 14*c* is opened, the flow control seal valve 15*b* is opened and the metering valve 15*e,* 15*f* throttling process begins. The valve 15*e,* 15*f* will open and seek a steady state position at the specified flow rate or formation pressure drawdown. Observing the flow control piston 15*c* position or the volume on the flow control log (FIG. 9) is a means of indicating that the sample bottle 14*c* is filling. Throttling ends when the sample bottle 14*c* volume reaches a predetermined value, e.g., 450 cc. A plurality of bottles 14*c* may be filled without recycling the flow control.

The flow control 17 is recycled by closing the probe isolation valve 11*a* (FIG. 7) and then opening another sample chamber. After recycling, the flow line will be at the pressure of the sample chamber 14*c*.

Figure 8B:
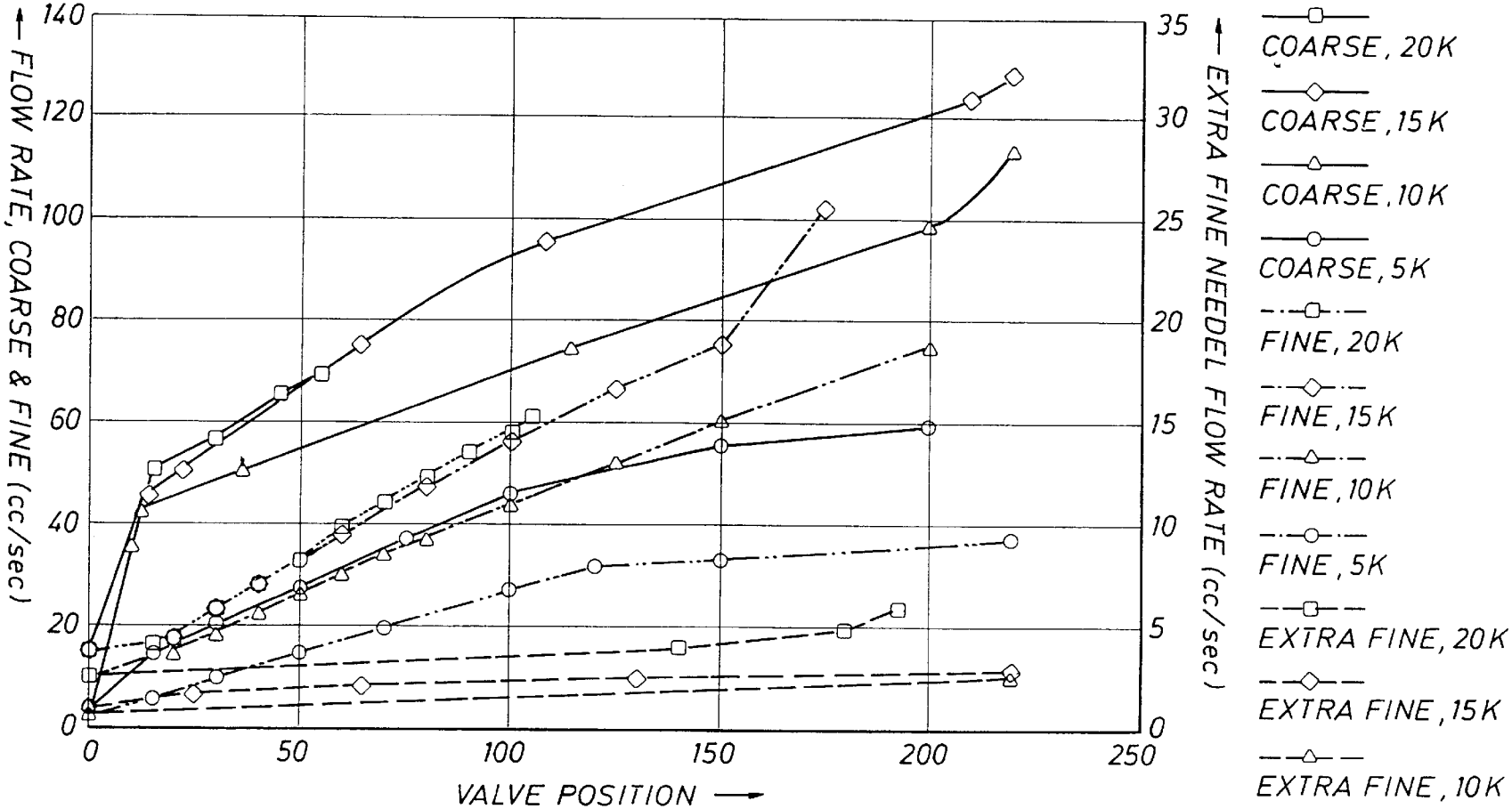
FIG. 8B is a graph showing the comparative performance of the valve according to the embodiments of FIG. 5 with pressures as high as 20,000 psi.

Referring now to FIG. 8B, it is seen that flow rates as low as 1 cc/sec are obtainable at pressures of 10,000 psi. It is also seen that very low flow rates can be maintained at pressures of 20,000 psi.

Figure 9:
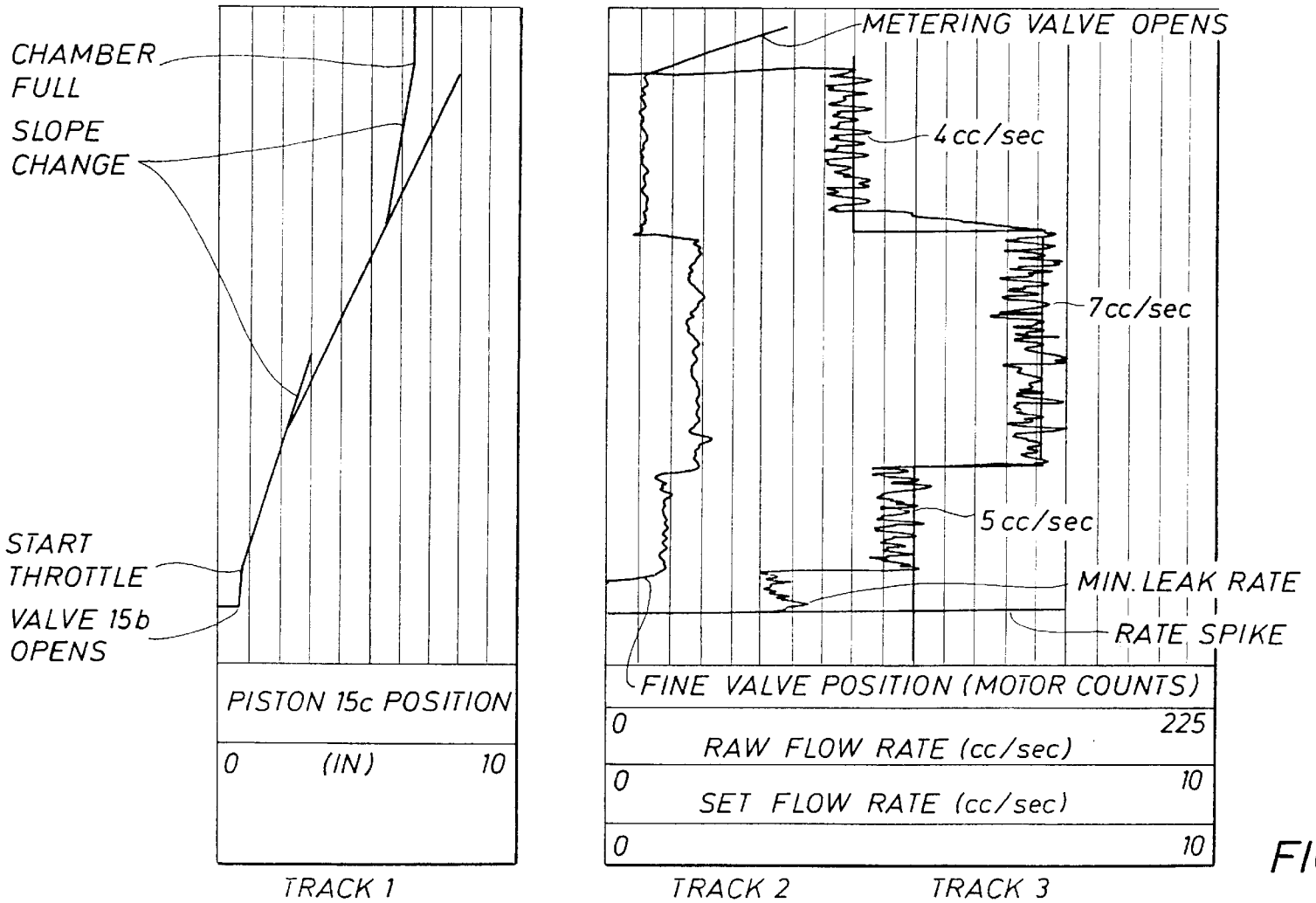
FIG. 9 is a log showing operational parameters of the invention in a typical test environment.

FIG. 9 illustrates a flow control log obtained using the flow control module 15 of the subject invention. Track 1 shows piston 15*c* position and slope change. Tracks 2 and 3 have been combined to show fine metering valve 15*f* position, set flow rate and raw flow rate. To obtain this log, the metering valves 15*e,* 15*f* and the seal valve 15*b* are initially closed and a set point for flow rate throttling is selected. For this log, the set point is 5 cc/sec as shown. When the seal valve 15*b* opens, the internal sample flow line and the metering oil 15*d* are compressed to formation pressure. This results in an immediate displacement of the piston 15*c* and a high calculated flow rate resulting in a rate spike as shown on the flow rate curve. The needle 15*e*1 then leaks at a minimum rate even though the metering valve 15*e* is closed. The piston 15*c* position increases during this time. When throttling begins, the metering valve 15*e,* 15*f* opens and the flow rate increases to the set point, 5 cc/sec. After some time, the set point is changed to 7 cc/sec and the metering valve 15*e,* 15*f* opens further to achieve the higher rate as shown. The piston 15*c* position increases at a faster rate as shown on Track 1. When the set point is changed to 4 cc/sec, the metering valve 15*e,* 15*f* closes down and the rate of increase of piston 15*c* position decreases as noted by the changes of slope on the piston 15*c* position log (Track 1). When the piston 15*c* reaches the end of its travel, the flow rate rapidly falls to zero and throttling ceases.

What is claimed is:

1. An apparatus for obtaining a representative fluid sample from a low permeability, high pressure formation, comprising:

a) a chamber in direct fluid communication with the formation for collecting said representative fluid sample;

b) control means for controlling a rate at which fluid flows into said chamber from the formation, the control means comprising a throttling valve having an orifice;

c) a needle operating within said orifice for varying said flow rate; and d) a seal valve for directing said representative fluid sample into said chamber and for isolating said chamber.

2. The apparatus of claim 1 wherein said needle is tapered at about one degree.

3. The apparatus of claim 1 wherein said needle is about 0.032 to 0.048-inch in diameter.

4. The apparatus of claim 1 wherein the position of said throttling valve is controlled by a motor.

5. The apparatus of claim 1 wherein said control means further comprises means for setting a control point at a specified flow volume per unit of time.

6. The apparatus of claim 5 wherein said specified flow volume is between ¼ cc/sec and 304 cc/sec.

7. The apparatus of claim 5 wherein said control point is maintained at a point above the bubblepoint of said representative sample of said formation fluid.

8. The apparatus of claim 5 wherein said formation pressure is between 2,500 and 20,000 psi and said specified flow volume is less than 10 cc/sec.

9. The apparatus of claim 1 wherein said control means further comprises means for setting a control point at a specified pressure differential below said formation pressure.

10. The apparatus of claim 9 wherein said control point is maintained at a point above the bubblepoint of said representative sample of said formation fluid.

11. A method for obtaining a representative fluid sample from a low permeability, high pressure formation, comprising the steps of:

collecting said representative fluid sample in a chamber that is in direct fluid communication with the formation;

controlling a rate at which fluid flows into said chamber from the formation by operating a throttling valve within an orifice;

operating a needle within said orifice to vary said flow rate; and directing said representative fluid sample into said chamber and isolating said chamber.

12. The method of claim 11 further comprising the step of setting a control point at a specified flow volume per unit of time.

13. The method of claim 12 further comprising the step of maintaining said control point at a point above the bubble-point of said representative sample of said formation fluid.

14. The method of claim 12 further comprising the step of obtaining said fluid sample when said formation pressure is between 2,500 and 20,000 psi and said specified flow volume is less than 10 cc/sec.

15. The method of claim 11 further comprising the step of setting a control point at a specified pressure differential below said formation pressure.

16. The method of claim 15 further comprising the step of maintaining said control point at a point above the bubble-point of said representative sample of said formation fluid.

* * * * *